US005483979A

United States Patent [19]

Bertieri

[11] Patent Number: 5,483,979

[45] Date of Patent: Jan. 16, 1996

[54] HAIR COLORING COMB

[76] Inventor: Fiorenza Bertieri, 211 W. 53rd St. (4F), New York, N.Y. 10019

[21] Appl. No.: 230,692

[22] Filed: Apr. 21, 1994

[51] Int. Cl.[6] ..... A45O 24/22

[52] U.S. Cl. ..... 132/114; 132/115; 401/152

[58] Field of Search ..... 132/112, 113, 132/114, 115, 902; 401/152; 119/83, 85

[56] References Cited

U.S. PATENT DOCUMENTS

| | | | |
|---|---|---|---|
| 2,624,348 | 1/1953 | Matson | 132/114 |
| 3,353,721 | 11/1967 | Love | 132/114 |
| 4,747,420 | 5/1988 | Alaimo | 132/112 |
| 4,902,154 | 2/1990 | Valenza | 401/132 |
| 4,934,388 | 6/1990 | Gibbs | 132/116 |
| 5,056,480 | 10/1991 | Murray, Sr. | 132/114 |
| 5,059,050 | 10/1991 | Guglieimo | 401/171 |
| 5,339,839 | 8/1994 | Forcelledo | 132/114 |

FOREIGN PATENT DOCUMENTS

| | | | |
|---|---|---|---|
| 0043519 | 1/1982 | European Pat. Off. | 132/112 |
| 0097322 | 1/1984 | European Pat. Off. . | |
| 2422359 | 12/1979 | France | 132/113 |
| 17669 | 1/1956 | Germany | 132/115 |
| 3934316 | 4/1991 | Germany | 132/112 |

*Primary Examiner*—John G. Weiss
*Attorney, Agent, or Firm*—Richard L. Miller

[57] ABSTRACT

A hair coloring comb is provided, which consists of a canister having a plurality of pliable squeeze areas. The canister holds a quantity of hair coloring liquid therein. A hollow spine body has a plurality of hollow teeth extending from a first end. A structure is for attaching in a removable manner a cooperating mating end of the hollow spine body to the canister. When the pliable squeeze areas are depressed, some of the hair coloring liquid will be forced from the canister through the hollow spine body and out of the hollow teeth whereby it may be applied onto the hair of a person.

7 Claims, 2 Drawing Sheets

HAIR COLORING COMB

BACKGROUND OF THE INVENTION

The instant invention relates generally to hair grooming devices and more specifically it relates to a hair coloring comb. Numerous hair grooming devices have been provided in prior art that are adapted to apply hair dye, perfume, viscous solutions, water, treatment solutions and the like to the hair. For example, U.S. Pat. Nos. 4,747,420 to Alaimo; 4,934,388 to Gibbs; 5,056,480 to Murray, Sr. and 5,059,050 to Guglielmo all are illustrative of such prior art.

While these units may be suitable for the particular purpose to which they address, they would not be as suitable for the purposes of the present invention as heretofore described.

SUMMARY OF THE INVENTION

A primary object of the present invention is to provide a hair coloring comb that will overcome the shortcomings of the prior art devices.

Another object is to provide a hair coloring comb that is structured with hollow teeth for properly applying hair coloring liquid to the hair through the hollow teeth.

An additional object is to provide a hair coloring comb in which the hair coloring liquid is forced through the hollow teeth by pressing pliable squeeze areas on a canister, so that the hair coloring liquid will travel through a hollow spine body and out of the hollow teeth.

A further object is to provide a hair coloring comb that is simple and easy to use.

A still further object is to provide a hair coloring comb that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
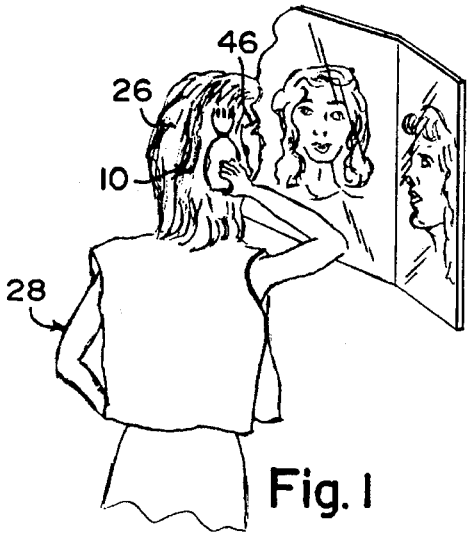
FIG. 1 is a diagrammatic perspective view of the instant invention in use.

Turning now descriptively to the drawings, in which similar reference characters denote similar elements throughout the several views, FIGS. 1 through 9 illustrate a hair coloring comb 10, which consists of a canister 12 having a plurality of pliable squeeze areas 14. The canister 12 holds a quantity of hair coloring liquid therein. A hollow spine body 16 has a plurality of hollow teeth 18 extending from a first end 20. A structure 22 is for attaching in a removable manner a cooperating mating end 24 of the hollow spine body 16 to the canister 12. When the pliable squeeze areas 14 are depressed, some of the hair coloring liquid will be forced from the canister 12 through the hollow spine body 16 and out of the hollow teeth 18 to be applied onto the hair 26 of a person 28, as shown in FIG. 1. The canister 12 can be fabricated typically out of flexible plastic and as a matter of design choice may be either transparent or opaque.

The attaching structure 22 includes an externally threaded neck 30 on a top end 32 of the canister 12. An internally threaded collar 34 is on the cooperating mating end 24 of the hollow spine body 16, which will thread onto the neck 30 of the canister 12.

Figure 2:
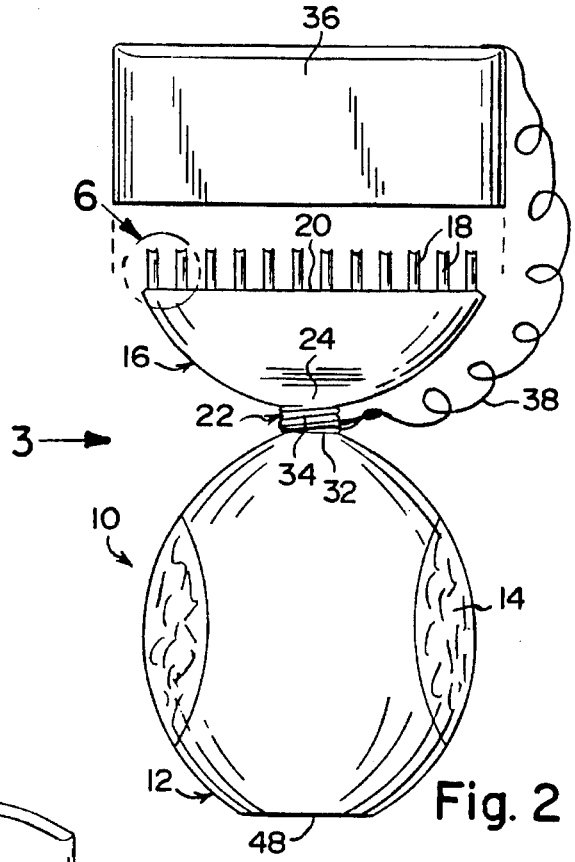
FIG. 2 is a diagrammatic elevational view of the instant invention per se with a protective cap separated therefrom and attached by a lanyard.
Figure 3:
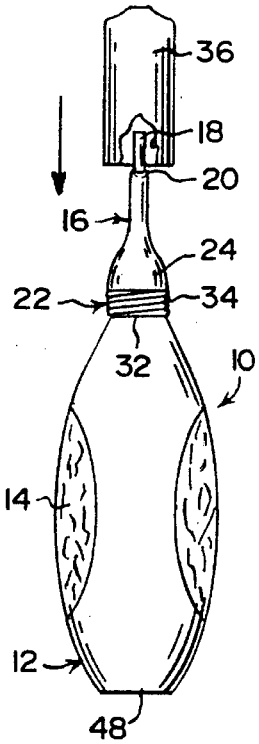
FIG. 3 is a side view taken in the direction of arrow in FIG. 2, with parts broken away.

A protective cap 36 fits over the hollow teeth 18 on the hollow spine body 16, when the hair coloring comb 10 is in storage and not in use. A lanyard 38, as shown in FIG. 2, can extend between the protective cap 36 and the collar 34 on the hollow spine body 16.

Figure 6:
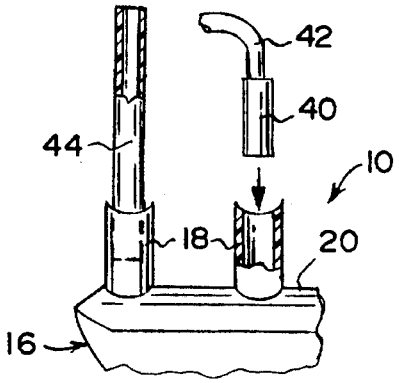
FIG. 6 is an enlarged diagrammatic elevational view of the area indicated by arrow 6 in FIG. 2 illustrating how an individual tooth can be blocked with a plug and a hollow tooth extender used for coloring eyebrows.
Figure 7:
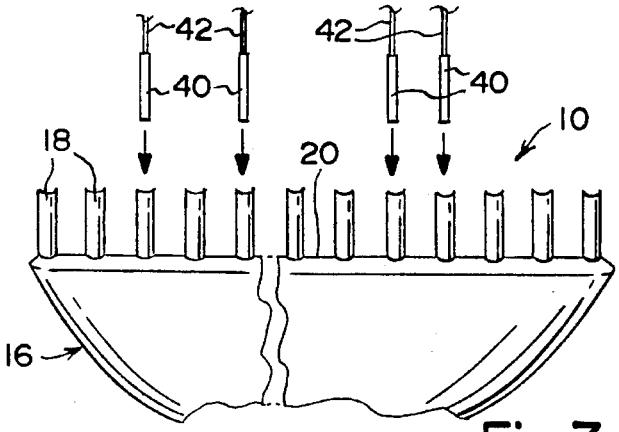
FIG. 7 is an enlarged diagrammatic elevational view with parts broken away further illustrating how different teeth can be blocked by a series of plugs to facilitate hair frosting techniques.
Figure 8:
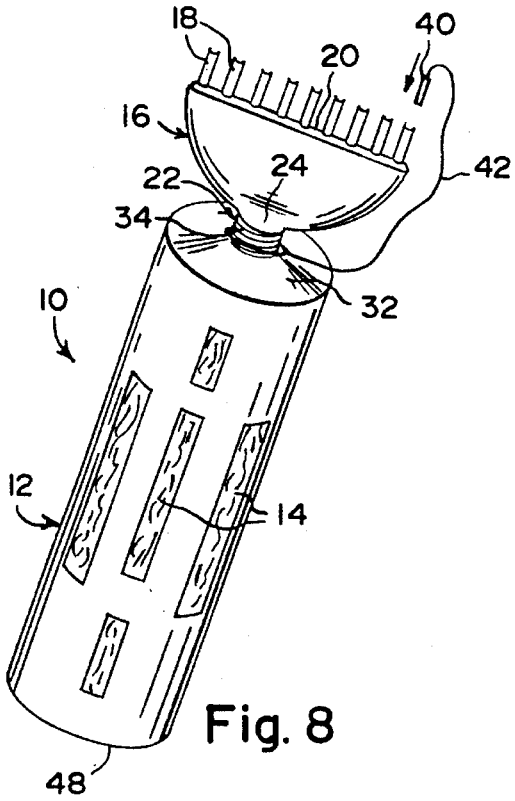
FIG. 8 is a perspective view of a fourth embodiment of the instant invention illustrating a circular cylindrical shaped canister.
Figure 9:
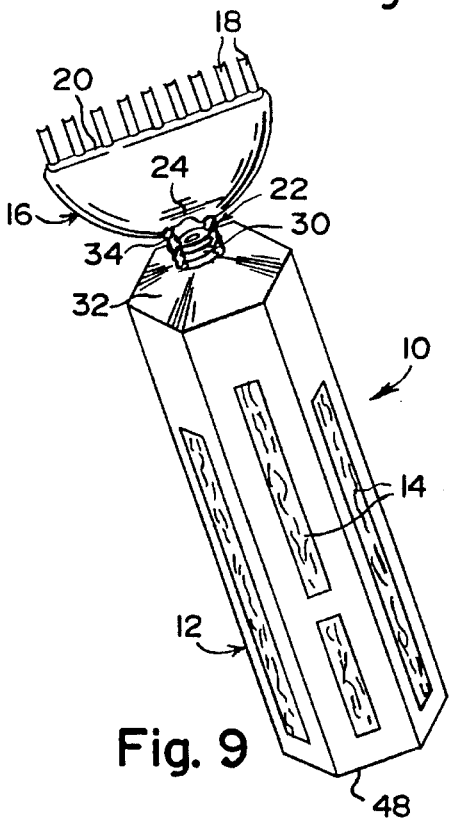
FIG. 9 is a perspective view of a fifth embodiment of the instant invention with parts broken away illustrating a hexagonal shaped canister.

As shown in FIGS. 6, 7 and 8, blocking pins 40 can fit into variously selected hollow teeth 18, to prevent the hair coloring liquid from exiting therefrom, so as to be used in frosting the hair 26 with appropriate streaking patterns. A lanyard 42 can also extend between each blocking pin 40 and the collar 34 on the hollow spine body 16. A hollow tooth extender sleeve 44, shown in FIG. 6, can fit into one hollow tooth 18 to allow the hair coloring liquid to exit therefrom, so as to be used in coloring the eyebrows 46.

Figure 4:
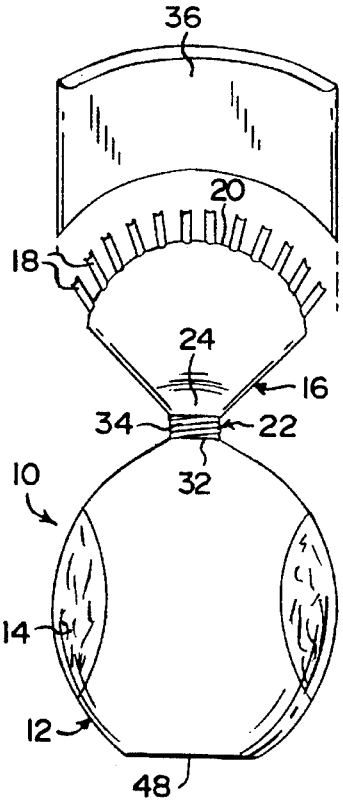
FIG. 4 is a diagrammatic elevational view similar to FIG. 2 of a second embodiment of the instant invention.
Figure 5:
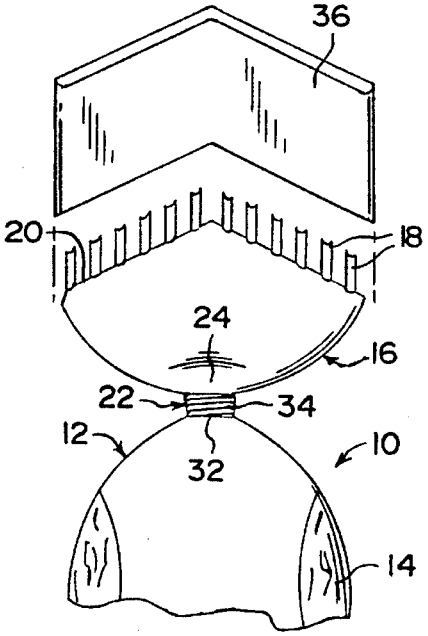
FIG. 5 is a diagrammatic elevational view similar to FIG. 2 of a third embodiment of the instant invention with parts broken away.

All the canisters 12 will have a flat base 48 so that they can sit upon a horizontal surface. The canisters 12 can also be fabricated in various geometric configurations, such as ellipsoidal in FIGS. 1 through 5, cylindrical in FIG. 8 and with a hexagonal cross section in FIG. 9. The hollow spine body 16 can also come in various geometric configurations, such as with a flat first end 20 in FIGS. 1, 2, 3 and 6 through 9. A round first end 20 is shown in FIG. 4, while a pointed first end 20 is shown in FIG. 5. The protective cap 36 will accordingly be shaped to fit over the teeth 18.

OPERATION OF THE INVENTION

To use the hair coloring comb 10, the person 28 grips the canister 12 by the hand and depresses the pliable squeeze areas 14. The hollow teeth 18 are placed into the hair 26, so that the hair coloring liquid can exit out of the hollow teeth and onto the hair 26. When the person 28 finishes using the hair coloring comb 10, the flat base 48 can be placed upon the horizontal surface. The protective cap 36 is then inserted over the hollow teeth 18 until the hair coloring comb 10 is used again.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A hair coloring comb which comprises:

a) a canister for holding a quantity of hair coloring liquid therein having a plurality of pliable squeeze areas;

b) a hollow spine body having a plurality of hollow teeth extending from a first end;

c) means for attaching in a removable manner a cooperating mating end of said hollow spine body to said canister, so that when said pliable squeeze areas are depressed some of the hair coloring liquid will be forced from said canister through said hollow spine body and out of said hollow teeth whereby said coloring liquid may be applied onto the hair of a person;

d) a plurality of individual blocking pins for fitting into selected individual hollow teeth thereby completely preventing flow of liquid out of said selected individual hollow teeth while leaving other individual hollow teeth open, for use in frosting the hair; and e) a hollow tooth extender sleeve fitting into one of said hollow teeth to allow the hair coloring liquid to exit therefrom, so as to be used in coloring the eyebrows.

2. A hair coloring comb which comprises:

a) a canister for holding a quantity of hair coloring liquid therein having a plurality of pliable squeeze areas;

b) a hollow spine body having a plurality of hollow teeth extending from a first end;

c) means for attaching in a removable manner a cooperating mating end of said hollow spine body to said canister, so that when said pliable squeeze areas are depressed some of the hair coloring liquid will be forced from said canister through said hollow spine body and out of said hollow teeth whereby said coloring liquid may be applied onto the hair of a person; and d) a hollow tooth extended sleeve fitting into one of said hollow teeth to allow the hair coloring liquid to exit therefrom, so as to be used in coloring the eyebrows.

3. A hair coloring comb as recited in claim 2, wherein said attaching means includes:

a) an externally threaded neck on a top end of said canister; and b) an internally threaded collar on said cooperating mating end of said hollow spine body which will thread onto said neck of said canister.

4. A hair coloring comb as recited in claim 3, further including:

a) a protective cap to fit over said hollow teeth on said hollow spine body when said hair coloring comb is in storage and not in use; and b) a lanyard extending between said protective cap and said collar on said hollow spine body.

5. A hair coloring comb as recited in claim 4, further including:

a) at least one blocking pin for fitting into one of said hollow teeth to prevent the hair coloring liquid exiting therefrom, for use in frosting the hair; and b) a lanyard extending between said at least one blocking pin and said collar on said hollow spine body.

6. A hair coloring comb which comprises:

a) a canister for holding a quantity of hair coloring liquid therein having a plurality of pliable squeeze areas;

b) a hollow spine body having a plurality of hollow teeth extending from a first end;

c) means for attaching in a removable manner a cooperating mating end of said hollow spine body to said canister comprising an externally threaded neck on a top end of said canister; and an internally threaded collar on said cooperating mating end of said hollow spine body which will thread onto said neck of said canister so that when said pliable squeeze areas are depressed some of the hair coloring liquid will be forced from said canister through said hollow spine body and out of said hollow teeth whereby said coloring liquid may be applied onto the hair of a person;

d) a protective cap for fitting over said hollow teeth on said hollow spine body when said hair coloring comb is in storage and not in use; a lanyard extending between said protective cap and said collar on said hollow spine body;

e) at least one blocking pin for fitting into one of said hollow teeth to prevent the hair coloring liquid exiting therefrom, so as to be used in frosting the hair; a lanyard extending between said at least one blocking pin and said collar on said hollow spine body; and f) a hollow tooth extender sleeve for fitting into one of said hollow teeth to allow the hair coloring liquid to exit therefrom, so as to be used in coloring the eyebrows.

7. A hair coloring comb according to claim 6 including a plurality of individual blocking pins for fitting into selected individual hollow teeth thereby completely preventing flow of liquid out of said selected individual hollow teeth while leaving other individual hollow teeth open, so as to be used in frosting the hair.

* * * * *